US008377221B1

(12) United States Patent
Taylor

(10) Patent No.: US 8,377,221 B1
(45) Date of Patent: Feb. 19, 2013

(54) APPARATUS AND METHOD FOR THE SAFE AND EFFICIENT CLEANING AND MAINTENANCE OF A VAULT HAVING SUBMERGED EQUIPMENT

(76) Inventor: Mark L. Taylor, Medford, OR (US)

( * ) Notice: Subject to any disclaimer, the term of this patent is extended or adjusted under 35 U.S.C. 154(b) by 314 days.

(21) Appl. No.: 12/841,390

(22) Filed: Jul. 22, 2010

(51) Int. Cl.
*B08B 5/04* (2006.01)

(52) U.S. Cl. ..... 134/21; 15/1.7; 210/241; 210/525; 210/527; 210/528; 210/540; 210/776; 134/34; 134/42

(58) Field of Classification Search ..... 15/1.7; 210/241, 525, 527, 528, 540, 776; 134/21, 134/34, 42
See application file for complete search history.

(56) References Cited

U.S. PATENT DOCUMENTS 2,918,127 A 12/1959 Bodine
3,191,206 A * 6/1965 Hamel ..... 15/1.7
3,262,571 A * 7/1966 Petretti ..... 210/297
4,184,954 A * 1/1980 Peterson ..... 210/791
5,609,124 A 3/1997 Leclerc
6,863,807 B2 * 3/2005 Crawford, III ..... 210/170.09
7,001,514 B1 * 2/2006 Liao ..... 210/219
2004/0226580 A1 * 11/2004 Shiraishi ..... 134/22.1
2005/0170935 A1 8/2005 Manser
2007/0072743 A1 3/2007 Serverino et al.
2007/0298937 A1 12/2007 Shah et al.
2011/0284031 A1 * 11/2011 Green ..... 134/18

* cited by examiner

*Primary Examiner* — Bibi Carrillo
(74) *Attorney, Agent, or Firm* — Jerry Haynes Law

(57) ABSTRACT

A system for cleaning and maintaining a vault includes a vault that may have equipment submerged in water. The vault includes a floor, at least one wall, and a cover that collectively define a vault interior. In some versions there is contaminated water in the vault that is at least one foot above the lowest point on the vault floor. In some versions, the water may be 12 to 14 feet above the lowest point on the floor. A portion of the floor may slope toward a vacuum head that is indirectly coupled with a source of suction. In some versions, at least the vault floor is lined with a liner that has a low coefficient of friction and is corrosive resistant. The source of suction may be a vacuum hose of a vacuum truck.

7 Claims, 5 Drawing Sheets

APPARATUS AND METHOD FOR THE SAFE AND EFFICIENT CLEANING AND MAINTENANCE OF A VAULT HAVING SUBMERGED EQUIPMENT

FIELD

This invention relates to a vault having submerged equipment. More specifically, this invention relates to a vault, with submerged equipment, that is configured for safe and efficient cleaning and maintenance of the vault.

BACKGROUND

Vaults with submersible equipment are used in a variety of applications. These vaults are often kept below ground. These vaults often include equipment that is submerged in water. Examples of vaults with submersible equipment include pump stations, wet wells, digesters, grease interceptors, storm pollution control structures, or other below-ground holding vessel, vault, or tank. In many cases, the water is waste water or other water with contaminants, such as, suspended particulates, waste matter, or pollutants. Over time, semi-solid or solid contaminants, such as sludge and debris can build up, especially along the bottom or floor of the vaults. These contaminants can damage submerged pumps, pollution control structures, and other equipment. These contaminants can also damage the walls and floor of the vaults. Vaults, especially those with submersible equipment, must therefore be cleaned from time to time.

Various apparatuses and methods have been used to clean vaults with submerged equipment. Many of these methods and devices are used in combination with vacuum trucks with storage tanks and cleaning equipment, such as Vactor Trucks®. Vactor Trucks® include a storage tank coupled with equipment and a hose. Waste water and other materials can be suctioned through the hose and into the storage tank of the Vactor Truck®. In addition, a Vactor Truck® can often shoot waste water out of the tank and hose. In some cases, a Vactor Truck® can alternate sucking in and shooting out waste water. As noted above, a Vactor Truck® may be used with other apparatus and methods to clean a vault with submerged equipment.

Many current methods of cleaning and maintaining a vault require a person to enter the vault. In at least some environments, entering a vault can be dangerous, even life-endangering. For example, a vault that is part of a sewer system may have standing water that presents a drowning hazard. Further, the floor of a vault may have slippery material that makes walking within the vault hazardous. Submerged equipment and pipes may compromise maneuverability. Sewer system vaults also may contain hydrogen sulfide ($H_2S$), a flammable and poisonous gas. The mixture of hydrogen sulfide gas and air can be explosive. Other dangerous gases, such as methane, may also be present. Oxygen levels may be low. Therefore, for human safety, it may be required to utilize safety procedures and equipment for confined spaces when entering a vault that is part of a sewer system. For example, sometimes an attendant, who remains outside of the vault, is required. For a human being entering a sewer system vault, a harness and other protective equipment may be required.

In designing apparatuses and methods for cleaning and maintaining vaults with standing water and equipment, various design considerations may be considered.

One possible design consideration is the extent to which a human being is required to enter the vault as part of the cleaning and maintenance. The entry of human beings into these vaults creates a risk of injury.

Another design consideration is the simplicity of the apparatus or method for cleaning and maintenance. For example, having a human being enter a vault takes time and may not be efficient. For example, sometimes a second human being must often be on site for safety reasons or to operate a hoist to retrieve the first human being from the vault.

Another possible design consideration is the extent to which an apparatus and method requires the insertion and manipulation of a vacuum hose in the vault interior for cleaning purposes. Manipulating a vacuum hose inside a vault is a cumbersome process, especially considering that floats, transducers, power cables, and other articles may be in the way. Thus, another possible design consideration is the extent to which the above equipment is needed to clean and maintain a vault.

SUMMARY

In some embodiments, a vault cleaning system includes a vault. The vault has submerged equipment and includes a floor, walls, and a cover that define an interior chamber. The interior is partially filled with contaminated water. In some embodiments, the water has a height at least one foot above the lowest point on the floor. In some embodiments, the water has a height between 10 and 12 feet above the lowest point on the floor.

In some embodiments, the vault has a suction tube that extends from a first tube end outside the vault, through a vault channel defined by the cover, into the interior, towards the vault floor, and ending at a second tube end, which is coupled with a vacuum head. The vacuum head is in contact with the vault floor and is coupled with the suction tube. A coupling mechanism, such as a cam lock, is configured to couple the first tube end with a source of suction for removing at least a part of the water and contaminants from the vault through the vacuum head.

In some embodiments, at least a portion of the vault floor slopes toward the vacuum head. In some embodiments the vault floor has a one percent slope toward the vacuum head. In some embodiments the vault floor has a two to five percent slope toward the vacuum head.

In some embodiments, at least the vault floor or a vault wall is lined with a liner that has a low coefficient of friction and is corrosive resistant. In particular embodiments, the liner includes a high-density polyethylene material.

In some embodiments, the source of suction is a vacuum hose of a vacuum truck, such as a Vactor Truck® and the coupling mechanism is a cam lock.

In some embodiments, a method of cleaning a vault includes using the coupling mechanism to couple a source of suction with the vacuum head, initiating the application of suction, and then continuing to apply suction to move water and contaminants into the vacuum head and out of the vault interior. The initiating is performed under conditions in which the contaminated water has a height of at least one foot from the lowest point on the vault floor and at least a portion of the vault floor slopes in the direction of a front opening of the vacuum head.

In some embodiments, the method includes performing the initiating under the additional condition that the floor is lined with a liner that has a low coefficient of friction and that is corrosive resistant.

BRIEF DESCRIPTION OF THE DRAWINGS

Certain embodiments of the invention may be understood by reference to the following detailed description read with reference to the accompanying drawings.

DETAILED DESCRIPTION

In the following description, various embodiments are described with reference to the various drawings. As a preliminary note before turning to the description, with reference to the drawings, some clarification is offered regarding terminology used in the description.

When multiple statements are made regarding "some embodiments", these "some embodiments" may or may not be the same sets of embodiments. Similarly, when multiple statements are made about "one embodiment," these statements may not be referring to the same embodiment. Also, unless the context indicates otherwise, the singular includes the plural.

Further, to aid understanding of the innovative features of the various embodiments, the drawings are simplified. To avoid obscuring innovative features with excessive detail, the drawings do not include all of the mechanical details that would be presented in complete, detailed, factory-production drawings. For example, the drawings omit the dimensions of most of the structures. Other structures are well-known to those skilled in the art and have been omitted to avoid unnecessary clutter and confusion. These include gaskets, vault wall segment intersections, the details of submerged equipment, and other details not necessary for an understanding of the innovative features of the embodiments.

Figure 1:
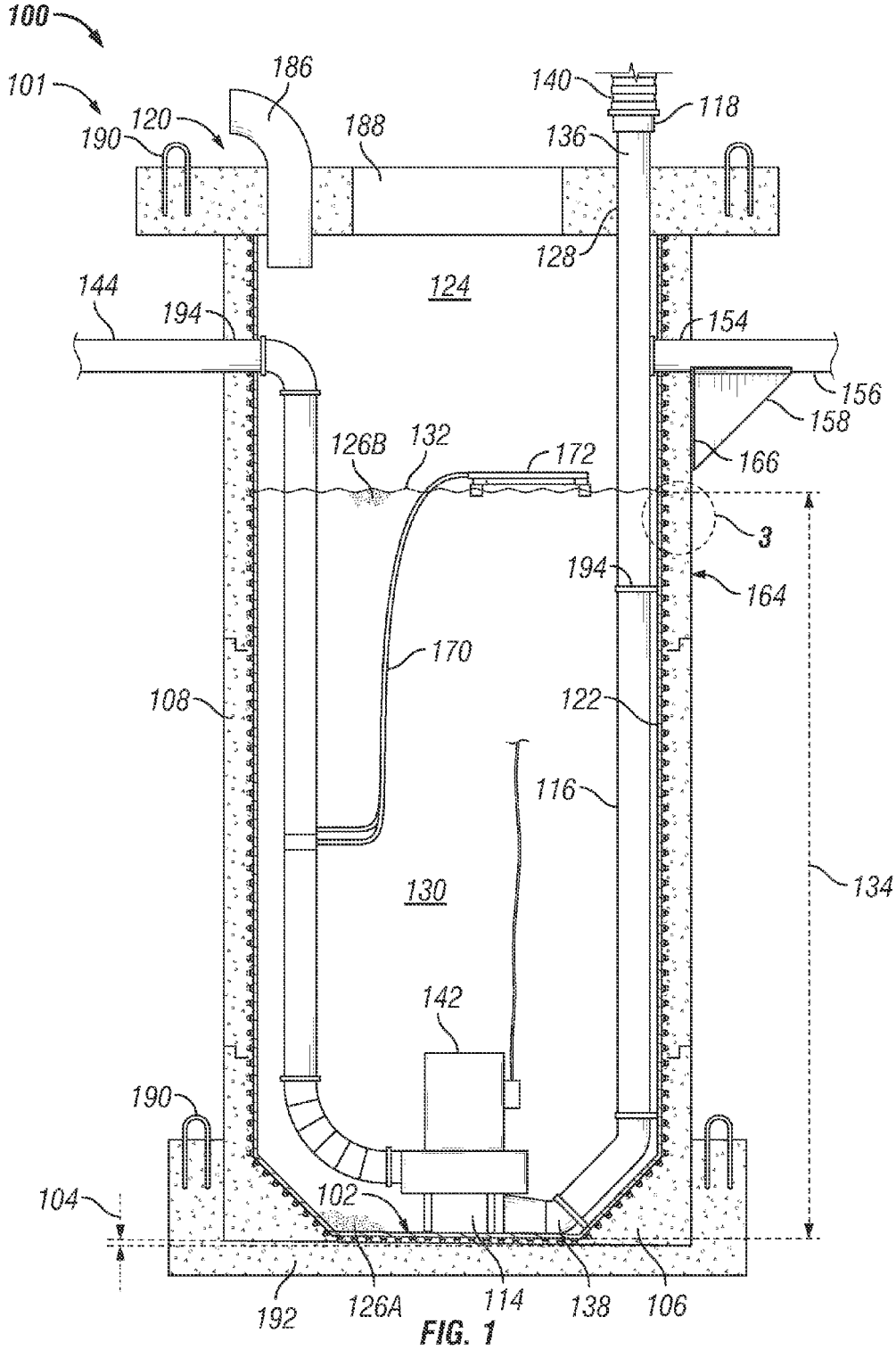
FIG. 1 is a cross-sectional side view of a vault cleaning system in accordance with some embodiments, showing a vault, a suction tube, a vacuum head and various components of the system.

Referencing FIG. 1, a vault cleaning system 100 includes a vault 101 that is configured for ease of cleaning and maintenance. As used in this document, the term "vault" is used in accordance with its ordinary meaning and is also used broadly to include below-ground holding vessels, pump stations, storm ceptors, catch basins, wet wells, digesters, chambers containing pollution control equipment and tanks.

Vault 101 includes a floor 102, at least one wall 108, and a cover 120 that collectively define an interior 124 of the vault 101. In some embodiments, prior to cleaning, the vault interior 124 is partially filled with contaminated water 130 that contains at least one contaminant 126A, 126B that are at least semi-solid. In some embodiments, examples of contaminated water 130 would include water comprising water pollutants, dissolved sewage, storm water run-off, dissolved fertilizer, suspended grease, mud, suspended decomposing organic material, and other contaminants. In some embodiments, examples of a contaminant 126A, 126B that is at least semi-solid includes, without limitation, sludge, debris, clumps of sewage, semi-solid or solid grease, semi-solid or solid decomposing organic material (e.g., compost, organic waste or garbage), rocks, chemical precipitates, previously dissolved pollutants that have come out of solution, slime, deposited material, and other semi-solid or solid contaminants.

Further referencing FIG. 1, in the embodiments shown, the vault 101 also comprises submerged equipment 142. In particular embodiments, the submerged equipment 142 may comprise water pumps. In other particular embodiments, the submerged equipment 142 may comprise a pollution control apparatus. In yet other particular embodiments, the submerged equipment 142 may comprise yet other types of equipment. In some embodiments, vault 100 does not comprise any submerged equipment 142.

The semi-solid or solid contaminants 126A, 126B can damage submerged equipment 142. But these semi-solid or solid contaminants 126A, 126B can be difficult to remove. Some of this type of contaminant 126A may adhere to the floor 102 of the vault. Some of this type of contaminant 126B may float on the surface 132 of the contaminated water 130.

Further referencing FIG. 1, in some embodiments, the vault system 100 comprises a vacuum head 114 for removing the contaminated water 130 and semi-solid or solid contaminants 126A, 126B from the interior 124 of the vault 101. The water 130 and contaminants 126A, 126B are removed from the interior 124 via a suction hose 116 that is coupled with both the vacuum head 116 and a source of suction 140 (in the embodiment shown, a vacuum hose). The source of suction 140 applies suction which moves the contaminated water 130 and semi-solid or solid contaminants 126A, 126B, through the vacuum head 114, through the suction tube 116 and out of the interior 124 of the vault 101 to the source of suction 140.

In some embodiments, the suction from the source of suction is increased by the height 134 of the surface 132 of the contaminated water 130 above the lowest point of the vault floor 102. In some embodiments, the height 134 of the contaminated water 130 above the lowest point of the vault floor 102 is at least one foot. In some embodiments, the height 134 of the contaminated water 130 above the lowest point of the vault floor 102 is between 10 and 12 feet. The height 134 increases water pressure at the vault floor 102 and therefore increases the suction exerted by the source of suction 140. Thus, vault cleaning system 100 incorporates the functions of hydraulics and static head to facilitate cleaning. That is the height 134 of the water surface 132 increases vacuum to remove the build-up of semi-solid or solid contaminants 126A on the vault floor 102.

Further referencing FIG. 1, in some embodiments, at least a portion of the floor 102 slopes toward the vacuum head 114. In some embodiments, the angle 104 of the slope of at least a portion of the floor 102 is a one percent slope in the direction the vacuum head 114. In some embodiments the slope is two to five percent. This slope further increases the power of the suction applied by the source of suction 140.

In some embodiments, the floor 102 is lined with a liner 122 that has a low coefficient of friction. This further aids the removal of semi-solid or solid contaminants 126A (e.g., sludge) that adhere to the floor 102. That is, the low coefficient of friction between the liner and the semi-solid or solid contaminants 126A increases the effectiveness of the suction applied by the source of suction 140.

Thus, in some embodiments, the suction applied by the source of suction 140 is more effective because of the combined effects of the water surface height 134 of greater than one foot, by the angle 104 of the slope of the floor 102 toward the vacuum head 114, and by the low coefficient of friction of the liner 122 that lines the floor 102.

The above discussion has summarized some of the features of some of the embodiments of a vault cleaning system. Now, with reference to FIG. 1, the structures of some embodiments of the vault cleaning system 100 are discussed in greater detail.

Consistent with the above discussion, some embodiments of vault cleaning system 100 have a suction tube 116. In some embodiments, the suction tube 116 begins at a first end 136 that is located outside the vault 101. In particular embodiments, suction tube 116 extends into the interior 124 of the vault through a suction tube channel 128 that is defined by the cover 120. In particular embodiments, the suction tube 116 extends toward the floor 102 and ends at a second tube end 138. Second tube end 138 couples with the vacuum head 114, which is disposed on the vault floor 102. Further, in some embodiments, suction tube 116 is coupled with the at least one wall 108 by at least one suction tube fastening mechanism 194—in the embodiment shown, a plurality of brackets.

In some embodiments, vault cleaning system 100 includes a coupling mechanism 118 configured to couple the first tube end 136 of the suction tube 116 with the source. of suction 140. In some embodiments (as shown), the coupling mechanism 118 is a cam lock. The source of suction 140 can be a vacuum hose (partial vacuum hose shown) of a vacuum truck (e.g., vacuum truck 193 of FIG. 8). Therefore, in some embodiments, the source of suction 140 can apply suction, which is communicated through the coupling mechanism 118, through the suction tube 116, and through the vacuum head 114. Contaminated water 130 and semi-solid or solid contaminants 126A, 126B are suctioned and removed into the vacuum head 114, through the suction tube 116, through the coupling mechanism 118, and out of the vault 101 and into the suction source 140. As discussed above, in some embodiments, this suction is strengthened by the height 134 of the surface 132 of the water 130 above the lowest point on the floor 102, by the angle 104 of the slope of the floor toward the vacuum head 114, and by the low coefficient of friction of the liner 122 lining the floor 102.

In some embodiments, the source of suction 140 (e.g., vacuum hose) which may be coupled with a vacuum truck (e.g., 193, FIG. 8) is also a source of force that is capable of exerting force to back-flush previously removed contaminated water 130 back into coupling mechanism 118, through suction tube 116, through vacuum head 114, and into the contaminated water 130 in the vault interior 124. This back-flushing raises the height 134 of the water surface 132 relative to the lowest point on the vault floor 102. The back-flushing loosens semi-solid or solid contaminants 126A (discussed in more detail below) adhering to the floor 102. In some embodiments, the back-flushing causes a wave action as the back-flushed contaminated water 130 contacts the at least one wall 108 and a steeply sloped floor portion (see discussion below). The wave action further loosens semi-solid or solid contaminants 126A adhering to the floor 102. When suction is applied again to remove contaminated water, the loosened semi-solid or solid contaminants are removed from the vault interior via the vacuum head 114, as discussed above.

In some embodiments, both the at least one wall 108 and the floor 102 are lined with liner 122. In some embodiments, in addition to the property of having a low coefficient of friction, the liner 122 is also corrosive resistant.

A variety of corrosive gases and agents are commonly found in, for example, sewage wet wells. These include hydrogen sulfide, sulfuric acid and sewer gases. For example, hydrogen sulfide can be produced when organic matter is decomposed by bacteria in the absence of oxygen. Sulfuric acid can be produced from hydrogen sulfide by biological processes. Besides its role in producing sulfuric acid, hydrogen sulfide can also be corrosive by reacting directly with certain metals. Hydrogen sulfide and other corrosive agents and gases are corrosive to materials used to build the floors 102 and walls 108 of vaults 101. These materials include concrete.

In some embodiments, liner 122 comprises a high-density polyethylene material ("HDPE"). HDPE is more resistant to corrosion from the corrosive agents and gases described above than is concrete. As used in this document, HDPE is therefore a corrosive resistant material. As used in this document, other materials that are equivalently or more resistant than HDPE to the corrosive effects of the above gases and agents are regarded as being corrosive resistant.

A coefficient of friction is a value used to describe the amount of friction between the surfaces of two bodies. "The ratio of the limiting friction to the normal reaction between sliding surfaces; the ratio is constant for a given pair of surfaces under normal conditions." G. H. F. Naylor, *Dictionary of Mechanical Engineering*, Jaico Publishing House, 1999, p. 163 (Page 163 is hereby incorporated by reference). Limiting friction is "The frictional force, which when increased slightly, will cause slipping." Id.

As discussed above, typical building materials for vault floors 102 include concrete. Some embodiments use suction to drag the bottom surfaces of semi-solid or solid contaminants 126A across the surface of concrete. Coefficients of friction can be determined to describe the amount of friction between the surfaces of semi-solid or solid contaminants 126A and concrete.

The coefficient of friction between HDPE and semi-solid or solid contaminants 126A is lower than that between semi-solid or solid contaminants 126A and concrete. For purposes of this document, if the friction between a material and semi-solid or solid contaminants 126A is equivalent to, or less than, that between semi-solid or solid contaminants 126A and HDPE, then that material is regarded as having a low coefficient of friction.

In some embodiments, liner 122 has the two properties of having a low coefficient of friction and of being corrosive resistant. In particular embodiments, liner 122 may comprise high-density polyethylene. In some embodiments, liner 122 may comprise fiberglass, "Raven Lining"—a spray-on coating by Raven Lining Systems, Liquid Boot® Membrane—a spray-on membrane by CETCO Remediation Technologies, polyvinyl chloride (PVC), or polypropylene.

Figure 3:
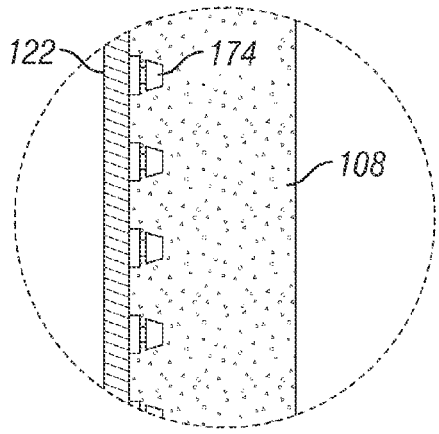
FIG. 3 is a cross-sectional side view of a portion of the vault of FIG. 1, showing a vault wall, a liner, and a stud liner, in accordance with some embodiments.

Referencing FIG. 3, liner 122 is coupled with the at least one wall 108 with a liner coupling mechanism 174, in the embodiment shown, a liner stud. Any known means of coupling a liner to a wall is within the scope of the embodiments. In alternative embodiments liner 122 may be a plate of solid, rigid material, or a sprayed-on material. As discussed above, liner 122 may comprise a variety of materials with a low coefficient of friction, resistance to corrosion, or both.

Returning to reference FIG. 1, as previously discussed, in some embodiments at least a portion of the floor 102 of the vault 101 slopes toward the vacuum head 114. In some embodiments, a steeply sloped floor area 106 borders the at least one wall 108 and surrounds the remaining portions of the floor 102. Thus, semi-solid or solid contaminants 126A that come to rest on the steeply sloped floor area 106 may slide down onto another portion of the floor 102 that is closer to the vacuum head 114.

Figure 2:
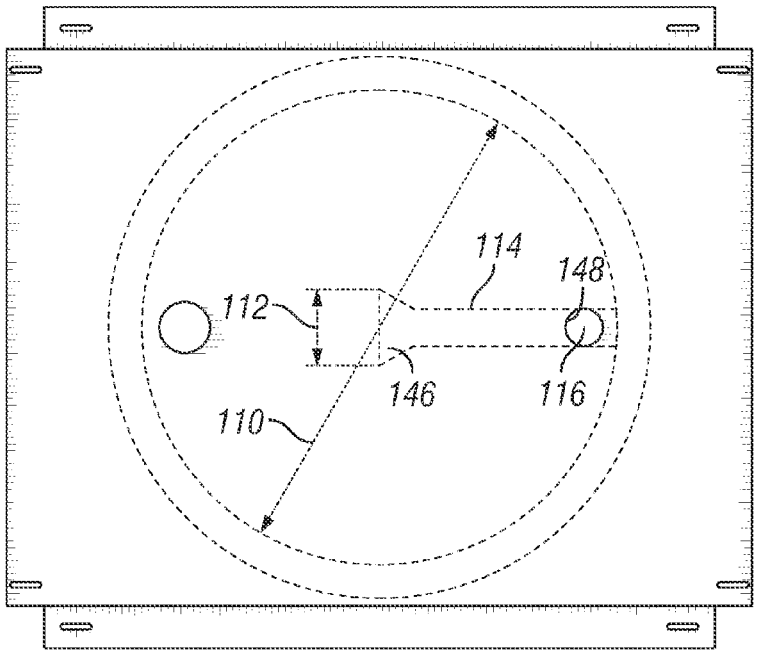
FIG. 2 is a top view of the vault of FIG. 1, showing a wall and a vacuum head in dotted line, in accordance with some embodiments.
Figure 1A:
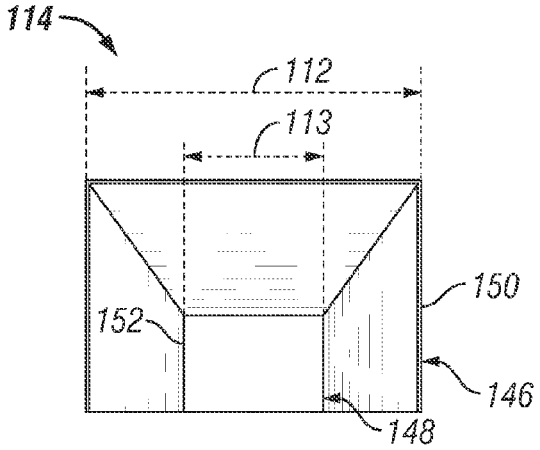
FIG. 1A is a front view of a vacuum head of the embodiment of FIG. 1, in accordance with some embodiments.

Referencing FIGS. 1A and 2, when the source of suction (i.e., 140 of FIG. 1) applies suction, contaminated water 130 enters vacuum head 114 through a front opening 146, leaves through a rear opening 148 and enters the suction tube 116. Both the front opening 146 and the rear opening 148 are defined by annular portions of the vacuum head 114. Thus, vacuum head 114 is typically filled with contaminated water 130 when there is contaminated water 130 in the vault interior 124.

To capture more contaminated water 130 and semi-solid or solid contaminants 126A, 126B (e.g., sludge), front opening 146 is a wide mouth. The front opening 146 defines both a front width 112 and a first perimeter 150 that are both greater than a rear width 113 and second perimeter 152 defined by the rear opening 148.

Referencing FIG. 2, in some embodiments the at least one wall 108 is only one wall and the vault 101 has circular shape in a top view. The at least one wall 110 defines an inside diameter 110 across the interior 124 of the vault 101. In some embodiments, there is a relationship between the diameter 110 of the vault interior 124 and the front width 112 of the front opening 146 of the vacuum head 114. In particular embodiments, the inside diameter is 6 feet and the front width 112 is 16 inches. In other particular embodiments, the inside diameter is 8 feet and the front width 112 is proportionately larger at slightly over 21 inches.

In some embodiments, the front opening 146 is positioned to be in contact with the vault floor 102 and at least a portion of the vault floor 102 slopes toward the front opening 146. In some embodiments, the slope is two to five percent.

Further referencing FIG. 1, in some embodiments, the vault 101 comprises a base 192. In particular embodiments the at least one wall 108 comprises stainless steel and the base 192 comprises concrete. In some embodiments, both the cover 120 and the base 192 include lifting eyes 190 for use in transporting the vault 101. In some embodiments, the cover includes a vent pipe 186, a tank lid 188 that opens to provide access to the interior 124 of the vault 101.

In some embodiments, the at least one wall 108 defines a water inlet channel 154. A water inlet tube 156 of the vault cleaning system 100 extends from outside the vault 101, through the water inlet channel 154, and into the interior 124 of the vault 101. In some embodiments, the vault cleaning system 100 includes a support device 158 to support the water inlet tube 156. The support device 158 is coupled with the at least one wall 108 and the water inlet tube 156 and is positioned relative to the water inlet tube 156 to allow the support device 158 to absorb the weight of the water inlet tube 146. In some embodiments, the support device 158 is coupled with the water inlet tube 156.

Figure 4:
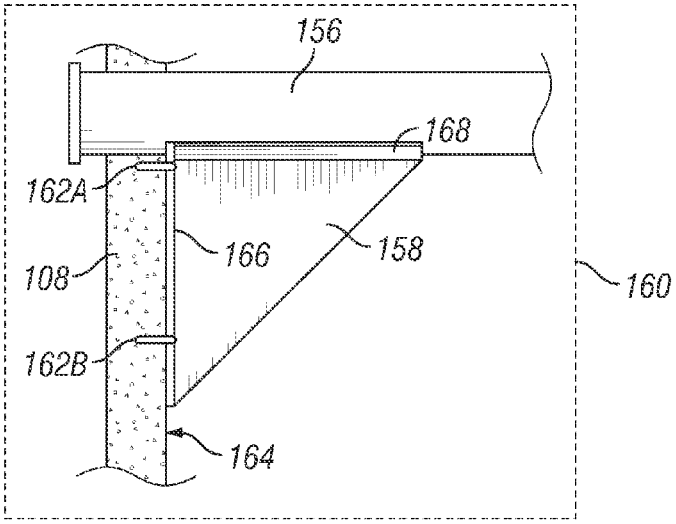
FIG. 4 is a two-dimensional side view of a support bracket for use with some embodiments.
Figure 5:
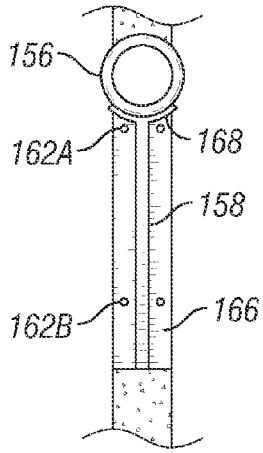
FIG. 5 is a two-dimensional end-view of the support bracket of FIG. 4.

Referencing FIGS. 4 and 5, in some embodiments, the support device 158 has a triangular shape in a plane 160 parallel to the gravitational attraction of the earth. In some embodiments, the support device 158 couples with the water inlet tube 156 via a saddle-shaped flange 168 that engages the weight of the water inlet tube 156, which in the embodiment shown is cylindrical. In further embodiments, the support device 158 has a base 166 for mounting to the exterior surface 164 of the at least one wall 108. In particular embodiments, the base is mounted to the exterior surface by a plurality of fasteners, e.g., 162A, 162B.

Further referencing FIG. 1, in some embodiments a vault cleaning system 100 includes a water main tube 144 that contains pressurized water. The water main tube 144 extends from outside the vault, through a pressurized water channel 194 defined by the at least one wall 108, and into the vault interior 124. In some embodiments, the water main tube 144 is coupled with the submerged equipment 142.

In some embodiments, a vault cleaning system 100 includes a sludge skimmer 172 that floats on the surface 132 of the water 130 in the vault interior 124. In particular embodiments, the sludge skimmer 172 is placed in hydraulic communication with water under pressure in the water main tube 144. When in such hydraulic communication, the sludge skimmer 172 is configured to rotate a member (e.g., 176, FIGS. 6 and 7) to break up semi-solid and solid contaminants 126B (e.g., sludge, fats, oils, or grease) that is floating on the contaminated water surface 132. The sludge skimmer 172 is placed in hydraulic communication with the pressurized water of the water main tube 144 by a coupling tube 170 (e.g., a hose) that couples, for hydraulic communication, with the water main tube 144 and the sludge skimmer 172.

Figure 6:
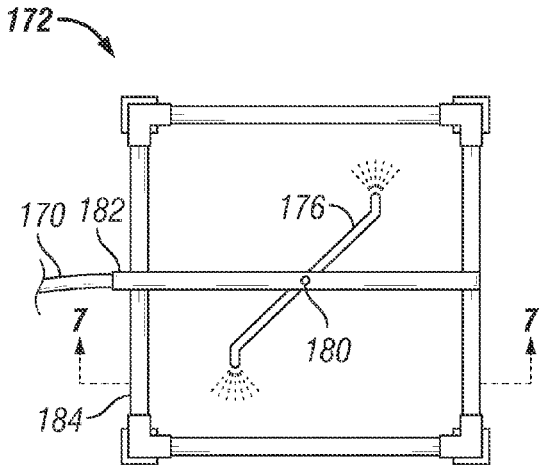
FIG. 6 is a two-dimensional top-view of a sludge skimmer that is suitable for use with some embodiments.
Figure 7:
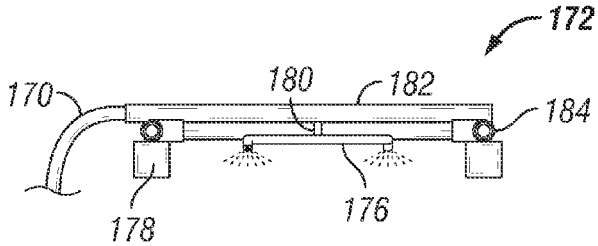
FIG. 7 is a two-dimensional side-view of the sludge skimmer of FIG. 6.

Referencing FIGS. 6 and 7, in some embodiments, pressurized water (e.g., from water main tube 144) flows from coupling tube 170 to tube attachment 182 of the sludge skimmer 172—and thus puts sludge skimmer 172 in hydraulic communication with the pressurized water. In response to the hydraulic communication, the sludge skimmer 172 is configured (e.g., similarly to a rotating lawn sprinkler) to use the pressurized water entering tube attachment 182 to cause a member 176 to rotate about a bearing 180 that is also coupled with tube attachment 182. That is, the rotating member 180 is rotatably coupled with the tube attachment 182 via the bearing 180.

As discussed above, the rotating member 176 breaks up semi-solid and solid contaminants 126B that is floating on the contaminated water surface 132. In various embodiments, the rotating member is a sprinkler assembly that rotates slightly above or within the water surface 132 and sprinkles water on or at the surface 132 of the contaminated water 130, to break up semi-solid and solid contaminants 126B. In other embodiments, the rotating member 176 could have combs descending from the member 176 into the surface 132 of the water to break up the semi-solid and solid contaminants 126B. In other embodiments, the member 176 is rotating at the surface 132 of the water to break up semi-solid and solid contaminants 126B.

The rotating member 176, bearing, and tube attachment 182 are all supported by a frame 184. In some embodiments, frame 184 is square shaped and made of PVC tubing. Clearly, other frames types are possible. Frame 184 is coupled with and supported on the water surface 132 by floats 178. Floats 178 may be composed of any of a variety of materials that float on water and that preferably do not degenerate in the presence of contaminated water 130. In some embodiments, floats 178 are plastic encased foam floats. In some embodiments, each side of the square-shaped frame 184 is approximately 1 foot and 8 inches in length. In some embodiments, the floats are cubical in shape, with dimensions or approximately 2"×2"×2". In some embodiments, the floats 178 are large enough to cause member 176 to rotate above the water surface 132 and sprinkle water on the surface 132. In some embodiments, the floats 178 are smaller and result in member 176 rotating at the surface 132 of the water 130.

Figure 8:
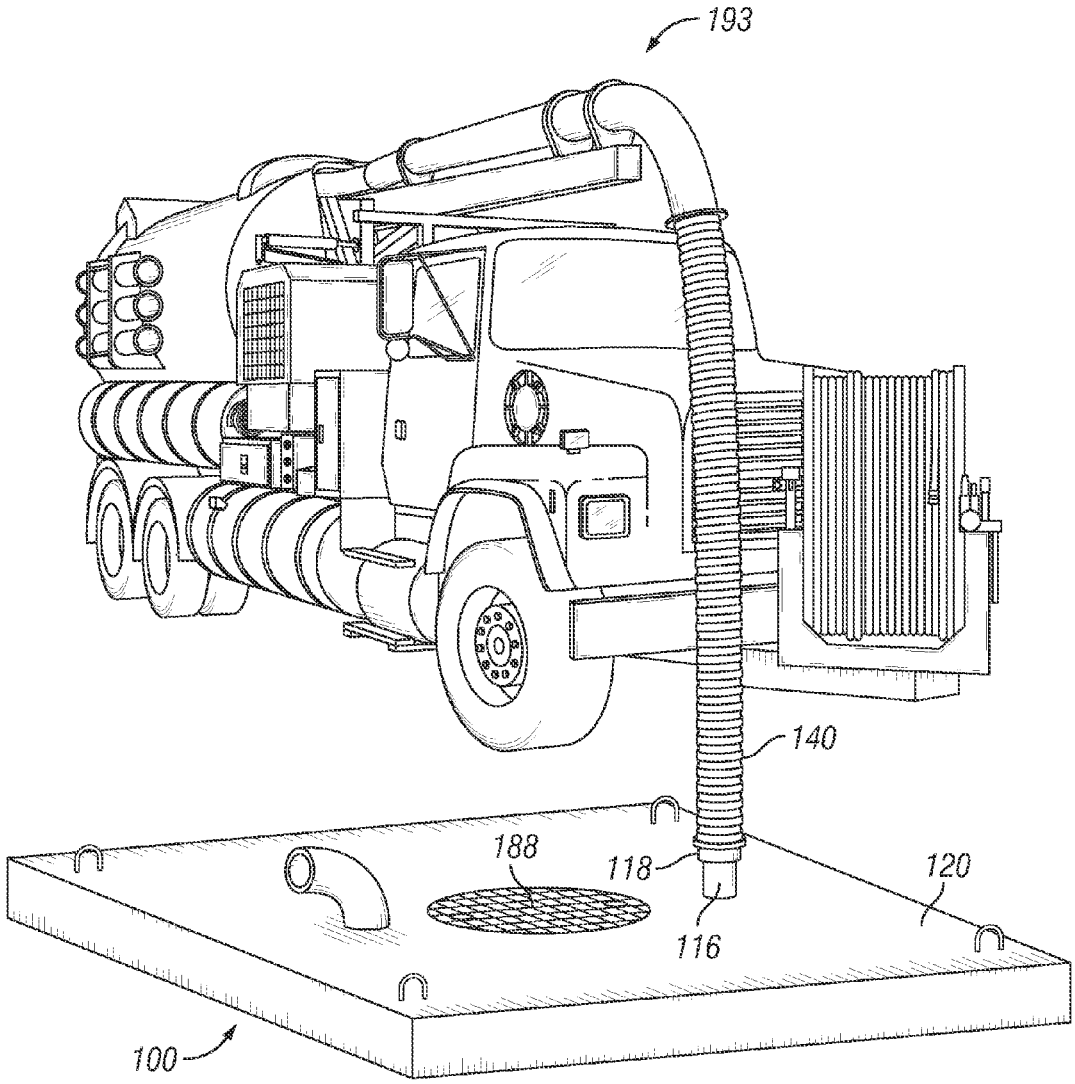
FIG. 8 is a perspective drawing of a truck with a storage tank and a vacuum hose that is capable of being used with some embodiments, showing the truck, the truck hose, and a tube with a cam lock, in accordance with some embodiments.

Referencing FIG. 8, vault cleaning system 100 is shown in an above-ground view. The cover 120 of vault 101 is visible. The suction hose 116 is coupled with, via coupling mechanism 118, with a source of suction 140 that is part of a vacuum truck 193. In some embodiments, vacuum truck 193 is a Vactor Truck® and the source of suction is a vacuum hose of the Vactor Truck®. Thus, a Vactor Truck® vacuum hose is coupled with coupling mechanism 118, which in some embodiments is a cam lock.

The vacuum truck 193 may be capable of applying either suction, to draw water into a tank of the truck. The vacuum truck may also be capable of applying force to shoot water from its tank into the source of suction 140 and into the coupling mechanism 118 and the suction tube 116. Thus, either suction to remove water from the vault interior or force to inject water into the vault interior can be performed without the necessity of opening tank lid 188 and without having a person or any object enter the tank interior via tank lid 188.

Figure 9:
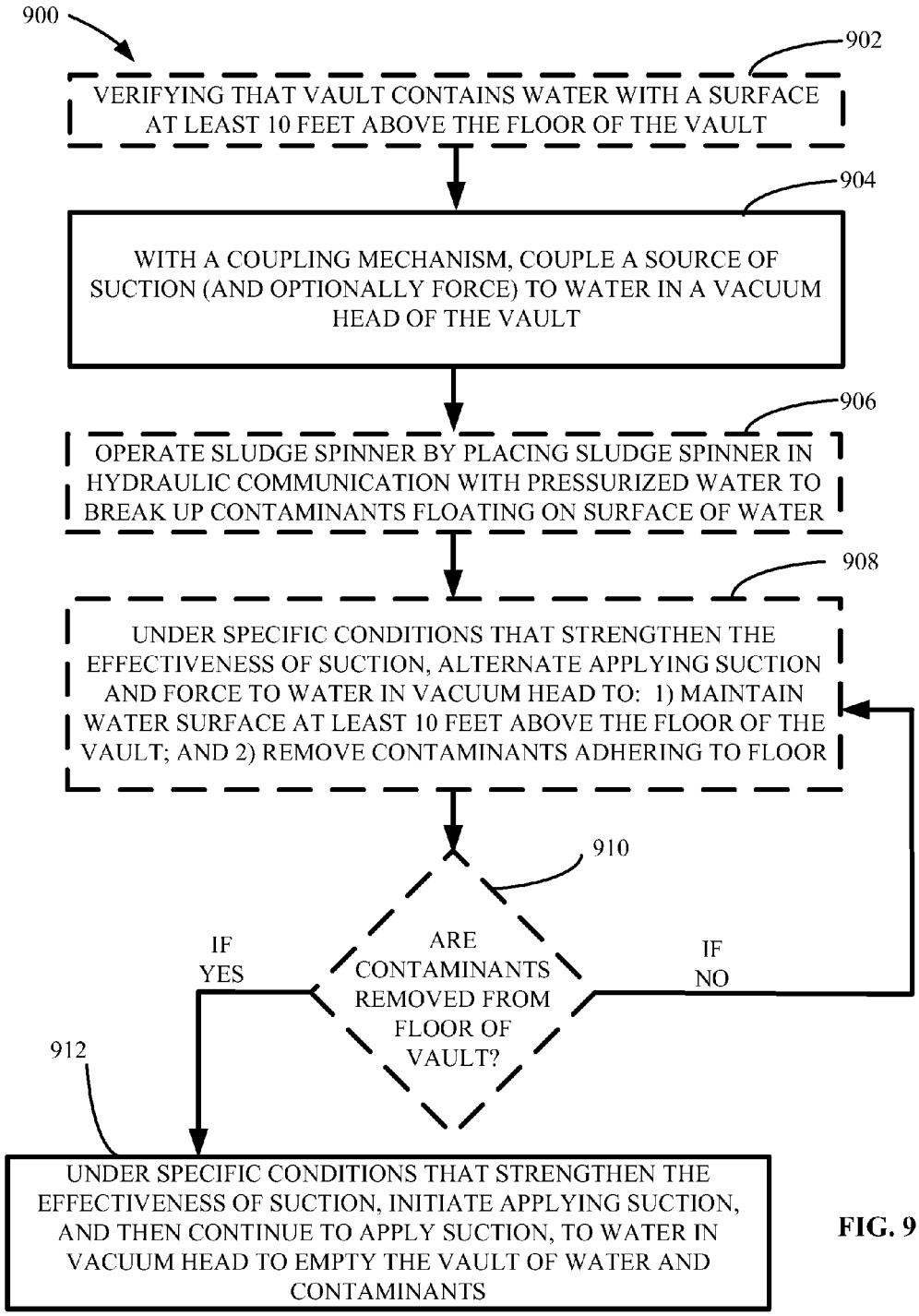
FIG. 9 is a flow chart illustrating a method for cleaning a vault, in accordance with some embodiments.

Referencing FIG. 9, in some embodiments, a method 900 of cleaning a vault optionally includes verifying 902 that the vault contains contaminated water and that the surface of the contaminated water has a height that is at least one foot above the lowest point of the floor. In some embodiments, the method includes verifying 902 that the surface of the contaminated water has a height that is between 10 and 12 feet above the lowest point on the floor. In some embodiments, there is already reason to believe that the surface of the contaminated water is at least one foot above the lowest point on the floor and the verifying 902 is not performed.

In some embodiments, method 900 includes using a coupling mechanism to couple 904 a source of suction with a vacuum head in the vault. As discussed above with reference to FIG. 1, a source of suction 140 is indirectly coupled with vacuum head 114 via coupling mechanism 118 and suction tube 116. Optionally, the source of suction may also be a source of force to inject water into the vault interior.

Moving forward with reference to block 912 of FIG. 9, in some embodiments, method 900 includes initiating the application of suction 912, and then to continue to apply suction, to water in the vacuum head to substantially empty the vault of water and contaminants. In some embodiments, the removed contaminants include semi-solid or solid contaminants 126A, 126B of FIG. 1. The application of suction is performed with source of suction discussed with reference to process block 904. Further, the suction is applied to the vacuum head to suction water and contaminants into the front opening of the vacuum head and out of the interior of the vault. The use of suctioning is not expected to result in the removal of every drop of water from the vault, thus the word "substantially" is used to denote the amount of removal that can reasonable be performed with suction equipment under the conditions enumerated below.

In some embodiments, initiating the application of suction 912 is performed only under certain conditions that strengthen the effectiveness of the suction. In some embodiments, the conditions include: 1) the vault comprises a vault floor, a cover, and a vault floor that define an interior of the vault; 2) the interior of the vault comprises contaminated water; 3) the contaminated water has a water surface that is at least one foot from the most distant point on the vault floor; 4) the vacuum head comprises a front opening that allows water to enter the vacuum head, the vacuum head contains some of the water, the front opening of the vacuum head is in contact with the vault floor, and at least a portion of the vault floor slopes toward the front opening of the vacuum head; and 5) the vault floor is lined with a liner with a low coefficient of friction (e.g., high density polyethylene).

In some embodiments, not all of the above conditions are present when the application of suction is initiated 912. For example, there may be contaminated water with a height above the lowest point on the floor of at least one foot, but the floor may not be sloped or may not be lined with liner. In some embodiments, a condition for the initiation 912 of the application of suction is that the contaminated water has a water surface that is between 10 and 12 feet from the most distant point on the vault floor. In some embodiments a condition for the initiation 912 of the application of suction is that the floor slopes one percent toward the vacuum head front opening. In some embodiments, the condition is that the floor slopes two to five percent toward the vacuum head front opening.

Referencing process block 906 of FIG. 9, in some embodiments, method 900 optionally includes operating a sludge skimmer (e.g., sludge skimmer 172 of FIGS. 1, 6, and 7). In some embodiments, operating the sludge skimmer includes placing the sludge skimmer in hydraulic communication with a source of pressurized water. For example, as described with reference to FIGS. 6 and 7, sludge skimmer 172 may be placed in hydraulic communication with pressurized water from water main tube 144 via coupling tube 170. In some embodiments, the sludge skimmer is configured to move about the surface of the water and break up surface contaminants in response to being in hydraulic communication with the pressurized water. In particular embodiments, as described with reference to FIGS. 6 and 7, sludge skimmer 172 breaks up sludge by rotating a member (e.g., a sprinkler assembly as shown in FIGS. 6 and 7).

In some embodiments, the sludge skimmer is used in a pump house and is turned on to operate with every pump cycle, preferably waste water is cycled to activate the skimmer. Thus, sludge, fats and other semi-solid contaminants are broken up shortly after they enter the vault.

Referencing process block 908, in some embodiments, method 900 option includes using a source of suction that is also a source of force to back flush water through the vacuum head, out of the front opening, and into the interior of the vault. As described above with reference to FIG. 1, previously removed contaminated water 130 can be back-flushed through the vacuum head 114 indirectly via the coupling mechanism 118 and then the suction tube 116.

In some embodiments, method 900 optionally includes alternating 908 between applying suction and force to the water in the vacuum head, the alternating being performed to maintain the height of the water surface at greater than ten feet above the most distant point on the vault floor and to remove semi-solid or solid contaminants that are adhering to the vault floor. The alternating 908 is performed before initiating 912 the application of suction to substantially empty the vault of fluid and water. In some embodiments, the alternating 908 is performed to maintain a water height of between 10 and 12 feet. In other embodiments, the alternating 908 is performed to maintain some other height that is greater than one foot.

As discussed above relative to FIG. 1, applying suction removes some of the contaminated water 130 and semi-solid or solid contaminants 126A, 126B from the vault via the vacuum head 114. Also, applying force back flushes previously removed contaminated water 130 through the vacuum head 114 and into the vault interior 101, loosening at least some of the semi-solid or solid contaminants 126A adhering to the floor 102. In some embodiments, the alternating is performed under the same conditions as for the initiating 912 the application of suction to substantially empty the vault of contaminated water and semi-solid or solid contaminants. Thus, the alternating 908 is a means for loosening and removing adherent semi-solid and solid contaminants 126A, 126B, while maintaining the desired static head by keeping the water height at greater than one foot. In some embodiments, the process of applying suction 912 to substantially empty the vault interior of water and contaminants is not performed until adhering semi-solid and solid contaminants have been removed by the alternating 908.

Referencing process block 910, in some embodiments, a method of cleaning a vault 900 optionally includes continuing 910 with the alternating 908 until adhering semi-solid and solid contaminants have been removed from the vault floor. In some embodiments, as long as there are semi-solid or solid contaminants on the floor, the alternating continues. In some embodiments, a determination is made of whether adhering semi-solid or solid contaminants have been removed from the floor, and dependent on that determination, alternating is continued, or suction is initiated to empty the vault of water and contaminants.

In some embodiments, once the semi-solid or solid contaminants are removed from the floor by the alternating 908, then the initiation 912 of suction to remove substantially all the contaminated water and contaminants from vault interior is performed. As used in this document, an adhering contaminant includes, for example, a heavy object such as a large rock. This is the case even though the large rock is "adhering" to the floor only because the rock's weight presses it against the floor.

In some embodiments, the source of suction used in method 900 is a vacuum truck with a vacuum hose. In particular embodiments, the vacuum truck is a Vactor Truck® with a vacuum hose. In some embodiments, the coupling mechanism used in process block 904 is a cam lock that is coupled, indirectly, with the vacuum head. In some embodiments, applying force and suction, in accordance with process blocks 908 and 912 of method 900 is performed by operating a Vactor Truck® to apply the suction and the force via a vacuum hose coupled to a coupling mechanism, such as a cam lock.

Thus, the various embodiments of method 900 are performed without a human being entering the vault. In some embodiments, the method is performed without moving the position of the vacuum head within the vault interior.

The foregoing embodiments and advantages are merely exemplary and are not to be construed as limiting the present invention. Those skilled in the art can appreciate from the foregoing description that the techniques and structures of the embodiments of the invention can be implemented in a variety of forms. For example, while the vault 101 of FIGS. 1 and 2 is circular in a top view, the principles described above would be applicable to a vault that is square, or oval or some other shape in a top view. Therefore, while the embodiments of this invention have been described in connection with particular examples thereof, the true scope of the embodiments of the invention should not be so limited since other modifications will become apparent to the skilled practitioner upon a study of the drawings, the specification, and the following claims.

I claim:

1. A method of cleaning a vault comprising the steps of:

using a coupling mechanism to couple a source of suction with a vacuum head in a vault;

initiating the application of suction, and then continuing the application of suction in the vault, to substantially empty the vault of water and contaminants, wherein the application of suction is performed using the source of suction and the suction is applied to the vacuum head to suction the water and contaminants into the vacuum head from an interior of the vault; and wherein the initiating the application of suction to substantially empty the vault of water and contaminants is performed under the following conditions:

the vault comprises a vault floor, a cover, and at least one wall that define the interior of the vault;

the interior of the vault comprises contaminated water and contaminants adhering to the vault floor;

the contaminated water has a water surface that is at least one foot from a most distant point on the vault floor; and the vacuum head is in contact with the vault floor, and at least a portion of the vault floor slopes toward the vacuum head;

wherein the source of suction is also a source of force which back flushes water through the vacuum head and into the interior of the vault, and wherein the method further comprises:

before substantially emptying the vault of water and contaminants, alternating between applying suction to the vacuum head and back flushing previously removed water from the vault, the alternating being performed to maintain a height of the water surface at greater than ten feet from the most distant point on the vault floor, wherein:

applying said suction to the vacuum head removes a portion of the water and contaminants adhering to the vault floor and back flushing loosens some of the contaminants adhering to the vault floor; and the alternating is performed under the same conditions as the initiating the application of suction to substantially empty the vault of water and contaminants.

2. The method of claim 1, wherein the alternating step is performed to maintain the height of the water surface 12 feet from the most distant point on the vault floor.

3. The method of claim 1, wherein:

the source of suction is a vacuum hose attached to a truck;

the coupling mechanism couples the vacuum hose with a cam lock to the vacuum head; and operating the truck to perform said alternating steps.

4. The method of claim 1, wherein the coupling and the applying suction are initiated under additional conditions that:

the vault floor has a two to five percent slope toward a front opening of the vacuum head; and the vault floor and the at least one wall of the vault are lined with a liner that is corrosive resistant.

5. The method of claim 1, further comprising:

operating a sludge skimmer, wherein:

operating the sludge skimmer comprises placing the sludge skimmer in hydraulic communication with a source of pressurized water;

and moving the sludge skimmer about the water surface to break up said contaminants.

6. The method of claim 1, wherein the method is performed without a human being entering the vault.

7. The method of claim 1, wherein cleaning the vault is performed without moving the vacuum head while applying the suction.

* * * * *